US007980004B2

(12) United States Patent
Klavano

(10) Patent No.: US 7,980,004 B2
(45) Date of Patent: Jul. 19, 2011

(54) FOOTWEAR WITH RETAINABLE STRAP

(75) Inventor: James K. Klavano, Kent, WA (US)

(73) Assignee: Australia Unlimited, Inc., Kent, WA (US)

( * ) Notice: Subject to any disclaimer, the term of this patent is extended or adjusted under 35 U.S.C. 154(b) by 845 days.

(21) Appl. No.: 11/968,590

(22) Filed: Jan. 2, 2008

(65) Prior Publication Data

US 2008/0155855 A1 Jul. 3, 2008

Related U.S. Application Data

(60) Provisional application No. 60/883,319, filed on Jan. 3, 2007.

(51) Int. Cl.
*A43B 3/12* (2006.01)

(52) U.S. Cl. ..... 36/11.5

(58) Field of Classification Search ..... 36/11.5, 36/101, 100

See application file for complete search history.

(56) References Cited

U.S. PATENT DOCUMENTS

| | | | | |
|---|---|---|---|---|
| 366,266 | A * | 7/1887 | Smithers | 36/58.5 |
| 4,476,600 | A | 10/1984 | Seidel et al. | |
| 5,960,565 | A | 10/1999 | Lochbaum | |
| 6,237,249 | B1 * | 5/2001 | Aguerre | 36/11.5 |
| 6,516,538 | B2 | 2/2003 | Kraft | |
| 7,055,265 | B1 | 6/2006 | Bathum et al. | |
| 7,222,442 | B2 * | 5/2007 | Hillyer et al. | 36/11.5 |
| 7,823,299 | B1 * | 11/2010 | Brigham | 36/101 |
| 2003/0009909 | A1 * | 1/2003 | Chen | 36/11.5 |
| 2004/0231189 | A1 | 11/2004 | Seamans | |
| 2004/0231190 | A1 | 11/2004 | Seamans | |
| 2004/0231191 | A1 | 11/2004 | Seamans | |
| 2006/0075656 | A1 * | 4/2006 | Januszewski et al. | 36/11.5 |
| 2006/0288610 | A1 * | 12/2006 | Laska et al. | 36/11.5 |

* cited by examiner

*Primary Examiner* — Ted Kavanaugh
(74) *Attorney, Agent, or Firm* — Frommer Lawrence & Haug LLP; Patrick R. Turner

(57) ABSTRACT

The invention relates to clog and sandal-type footwear having a sole and a heel strap. The heel strap is pivotable to be selectively secure the sole to a foot of a user or to be selectively retained by a channel formed in a heel portion of the sole. The heel strap may be permanently or removably attached to the sole.

10 Claims, 5 Drawing Sheets

FOOTWEAR WITH RETAINABLE STRAP

CROSS-REFERENCE TO RELATED APPLICATION

This application claims the benefit of U.S. Provisional Patent Application No. 60/883,319, filed Jan. 3, 2007, which application is incorporated herein by reference in its entirety.

FIELD OF THE INVENTION

The present disclosure is directed to footwear, and more particularly to casual footwear.

BACKGROUND OF THE INVENTION

Clog and sandal-type footwear is gaining in popularity due to such footwear's comfort, simplicity and flexible styling. A conventional clog, for example, includes a footpad or sole portion that is typically attachable to the foot by straps over the instep, toes and/or ankle. Various clog and sandal designs are available, including sandals suitable for formal wear, sporting wear, casual wear, and/or beach wear. For example, a thong is a type of sandal having a sole, such as a flat rubber sole, that is held onto the foot by a strap that slips between the big toe and the second toe of the user's foot.

With recent advances in the design and production of polymeric materials having desirable cushioning, traction, appearance, strength and resistance to wear, sandals are becoming popular that are made predominantly from elastomeric and other polymeric materials. Such sandals have advantages in design options, manufacturability, and comfort.

Many sandals, such as thong-type sandals, or flip-flops, rely on a strap attachment at the forward portion of the foot, allowing the heel portion to move away from the foot during use. An advantage of flip-flop-type sandals are that they are very easy to slip on, or take off, and they are very comfortable to many users. Another style of sandal includes a strap or other support structure that extends around the back of the user's foot, and generally over the top of the user's heel, to hold the heel portion of the sole in closer proximity to the user, and to more securely attach the sandal to the user's foot. However, sandals with a conventional heel strap can be uncomfortable to the user, and are more difficult and time-consuming to put on and take off.

Typically, a user must elect between a flip-flop style sandal and a heel strap style sandal.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
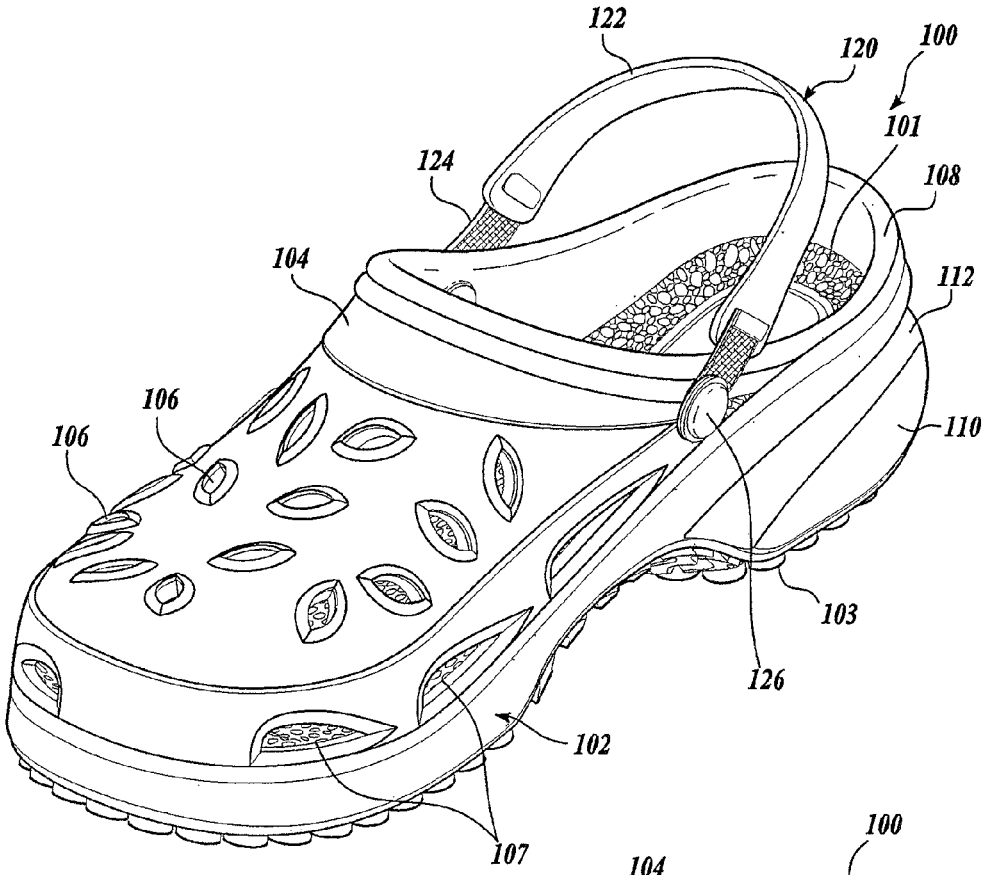
FIG. 1 is a front perspective view of an embodiment of a clog made in accordance with the present invention.
Figure 2:
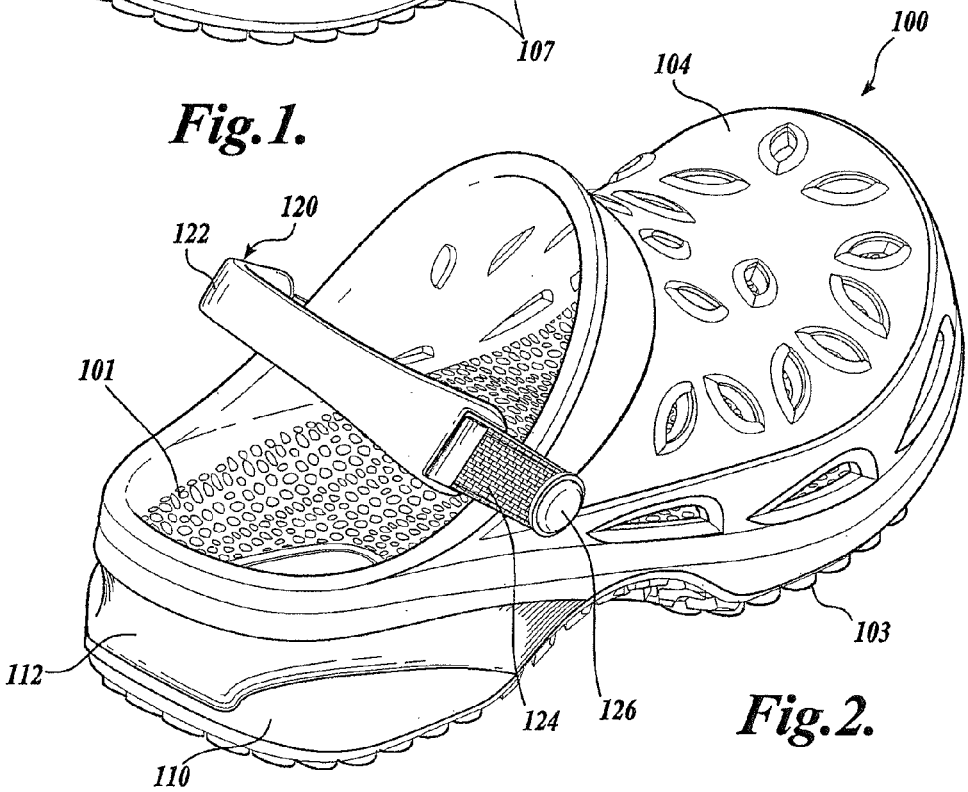
FIG. 2 is a three-quarter rear perspective view of the clog shown in FIG. 1.
Figure 3:
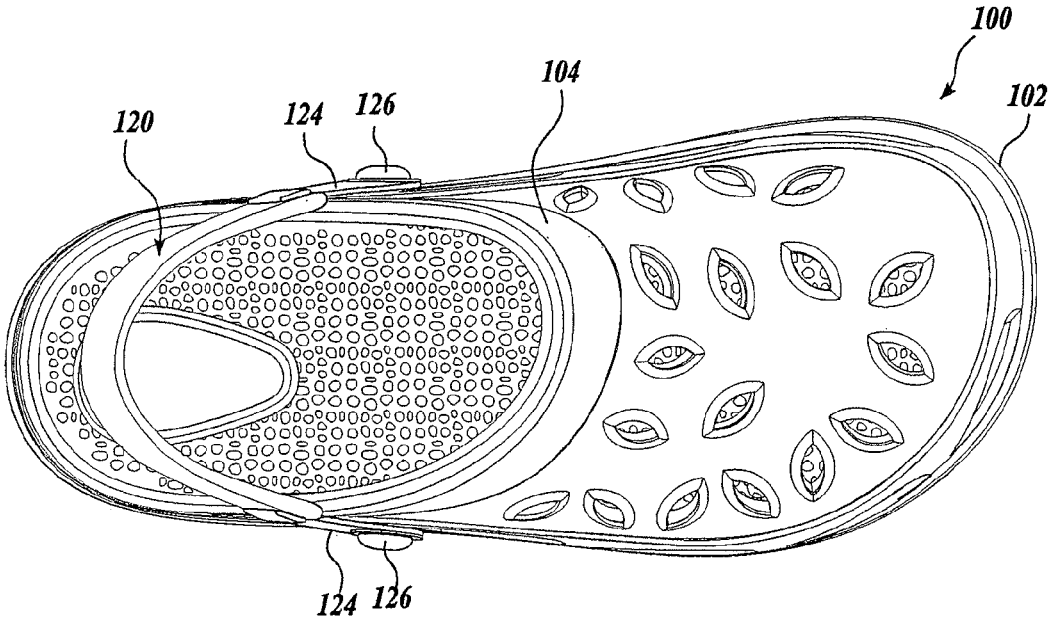
FIG. 3 is a top view of the clog shown in FIG. 1.

FIGS. 1-8 show various views of an embodiment of a clog 100 according to the present invention. The clog 100 includes a sole 102, an instep upper portion 104 and a heel strap 120. The sole 102 and instep upper portion 104 may be formed as an integral unit, or they may be formed separately and then assembled using conventional assembly methods such as stitching, adhesives, heat or RF welding, or the like. In a current embodiment, the sole 102 and the instep upper portion 104 are formed as a unitary member and molded from a foam polymer. It will be appreciated, of course, that other known manufacturing methods, including co-molding and similar techniques may alternatively be used, for example to use different materials for the sole 102 and instep upper portion 104. It is contemplated that a polypropylene-based thermoplastic rubber or rubber blend, for example, would be suitable for the clog 100.

The sole 102 itself may be of unitary construction, or may include a last or other footsole element (not shown). The optional last or other footsole element may be embedded in a foam outer layer to provide desired strength, stability and/or flexibility properties. For example, it is contemplated that a lighter foam material, such as an ethylene vinyl acetate ("EVA") foam may be co-molded with a polypropylene-based thermoplastic to form the sole 102, for example, to reduce weight and provide additional cushioning, conformability and comfort for the user. It is known that EVA foams tend to conform to a user's foot over time, which would further enhance the comfort of the clog 100.

As shown in the figures, the instep upper portion 104 in the disclosed embodiment includes a number of upper apertures 106 and peripheral apertures 107, that provide ventilation, reduce weight, and add desirable aesthetic attributes to the clog 100. The instep upper portion may also be provided with other embossing, texturing and/or printing (not shown), for example to provide identifying indicia and/or other decorative attributes. It will be appreciated that footwear according to the present invention may be made in other embodiments other than clogs. For example, a flip-flop sandal may be constructed in a straightforward manner by generally replacing the instep upper portion 104 of the clog 100 with a narrower strap and upright connector positioned to be disposed between two of the user's toes. Alternatively, the instep upper portion 104 may be formed as a narrower transverse strap, thereby exposing the user's toes during use.

Referring again to the figures, the upper surface 101 of the sole 102 may be formed with a textured pattern, thereby providing improved ventilation under the user's foot, and increasing the user's comfort. The sole 102 is preferably contoured, such that the upper surface 101 generally conforms to the anatomical shape of the human foot. For example, the instep region 109 of the upper surface 101 if provided with an orthopedically correct arch, to support the user's foot and increase the comfort level.

Figure 4:
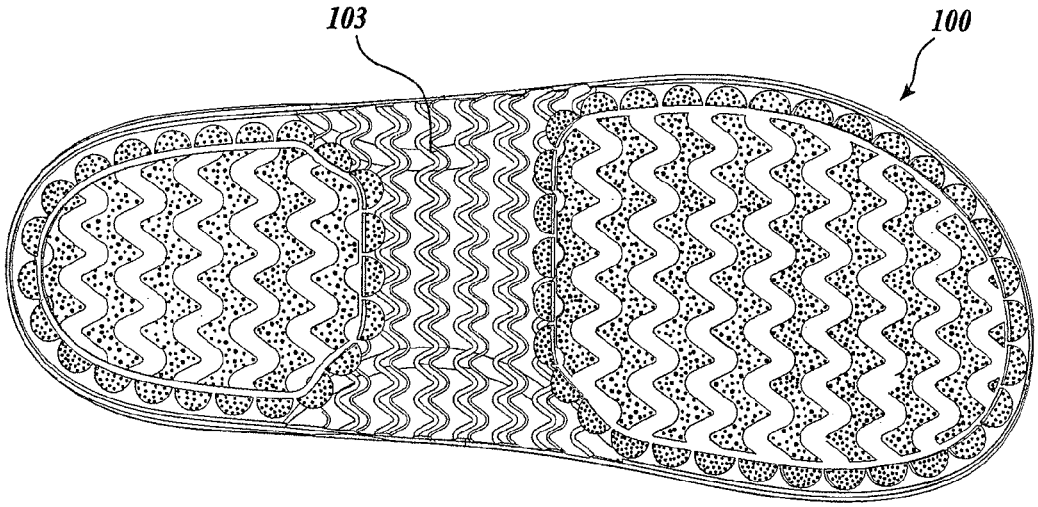
FIG. 4 is a bottom view of the clog shown in FIG. 1.
Figure 5:
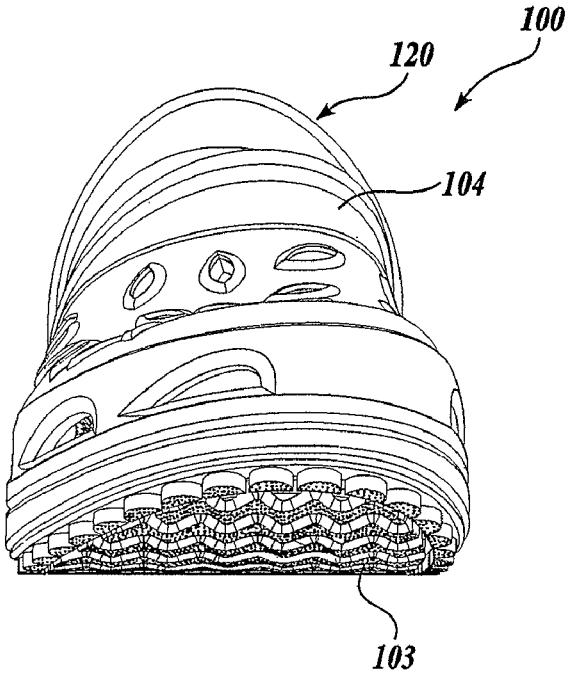
FIG. 5 is a front view of the clog shown in FIG. 1.
Figure 6:
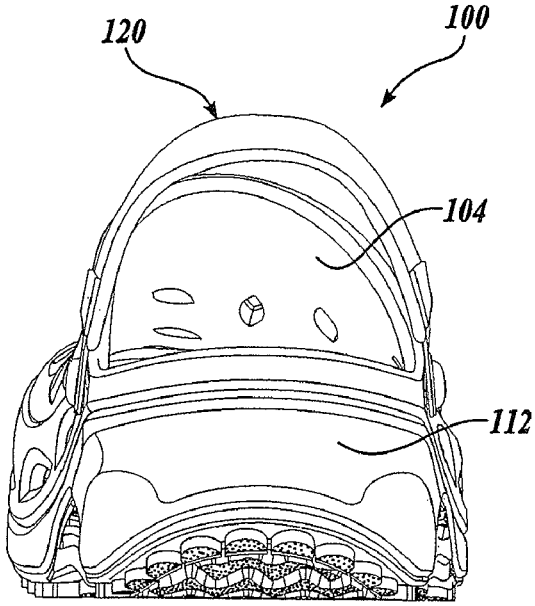
FIG. 6 is a rear view of the clog shown in FIG. 1.
Figure 7:
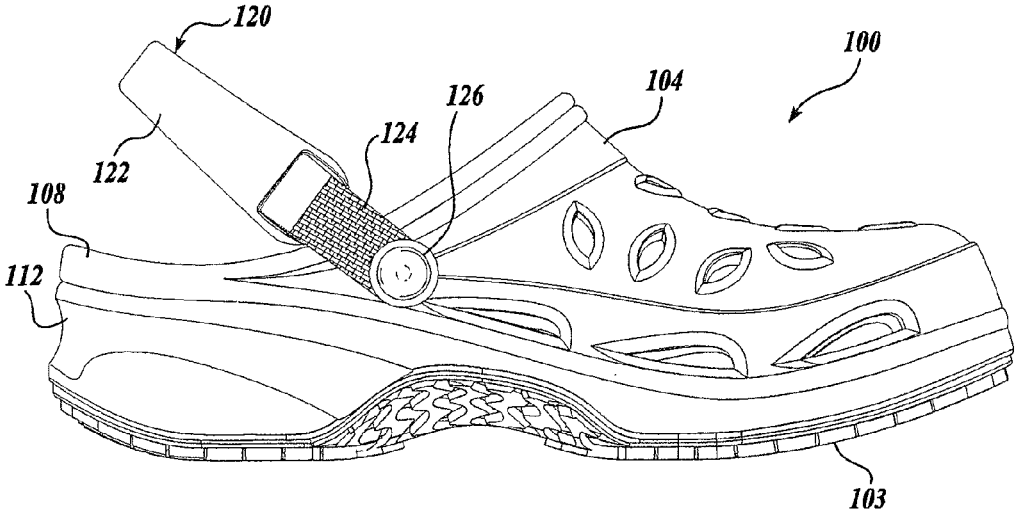
FIG. 7 is a right side view of the clog shown in FIG. 1.
Figure 8:
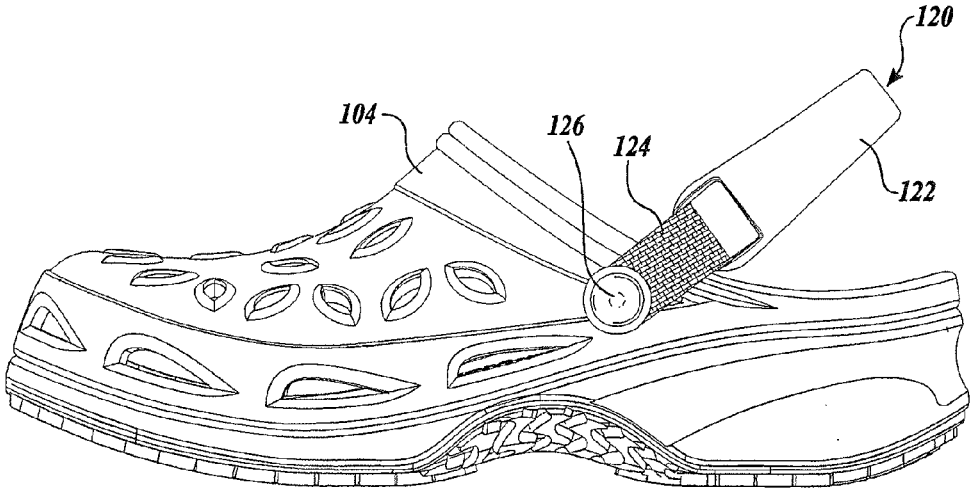
FIG. 8 is a left side view of the clog shown in FIG. 1.

As seen most clearly in FIG. 4, the sole 102 preferably includes a contoured and/or textured bottom surface 103 forming a tread that improves the grip and reduces the risk of slipping during use. It will be appreciated that the use of a suitable foam polymer for the sole 102 also enhances the grip of the clog 100, and reduces the risk of slipping. The sole 102 may also include a short rearward riser portion 108 that cups the lower portion of the user's heel, e.g., generally over the calcaneus bone.

A heel portion 110 of the sole 102 includes a groove or channel 112 that extends generally around at least portion of the perimeter of the heel portion 110. The channel 112 is sized and positioned to accommodate and selectively retain the heel strap 120, as discussed in more detail below.

The heel strap 120 in the current embodiment, includes a pliable intermediate portion 122, and stretchably elastic end portions 124. The intermediate portion 122 is an elongate member, that may be formed, for example, from a foam polymer. For convenience and aesthetic purposes, the foam polymer material may be the same foam polymer that is used to fabricate the sole 102 and/or instep upper portion 104. The elastic end portions 124 have a much greater elasticity than the intermediate portion 122, and function generally as springs or shock absorbers for the intermediate portion 122. For example, the end portions 124 may be elastically stretchable to a length of between about 1.2 to 2.0 times their unstretched or relaxed length. A suitable elastic material is a fabric material having longitudinal embedded rubber or rubber-like strands, as are well known in the art. It has been found that this unique strap construction provides a greater level of comfort to the user than conventional, less elastic heel straps.

In the current embodiment, the end portions 124 each have a proximal end that is fixedly attached to the intermediate portion 122 by any conventional means, and a distal end that is removably attachable to sole 102 with a snap 126 via an attachment point on the sole 102 or instep upper portion 104. Other releasable attachment mechanism may be used without departing from the present invention. Alternatively, the heel strap 120 may be permanently attached to the sole 102, for example with rivets or the like, or may be permanently attached at one end, and releasably attached at the opposite end. It will be appreciated that the snap 126 permits the heel strap 120 to readily pivot to an upper or lower position to accommodate the particular user. It will be appreciated that the elastic end portions 124 allow the strap to comfortably secure the clog 100 to a range of foot geometries, with the elastic end portions 124 also providing a shock absorbing functionality that is not provided by conventional straps.

Figure 9:
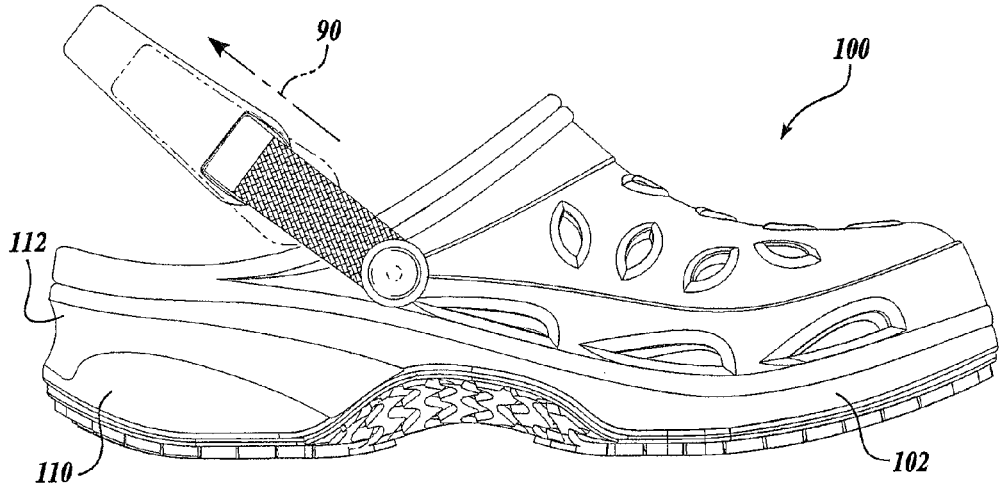
FIG. 9 is a right side view of the clog shown in FIG. 1 illustrating how the heel strap may be stretched rearwardly, either to accommodate the user's foot or for moving the heel strap to a retained position.
Figure 10:
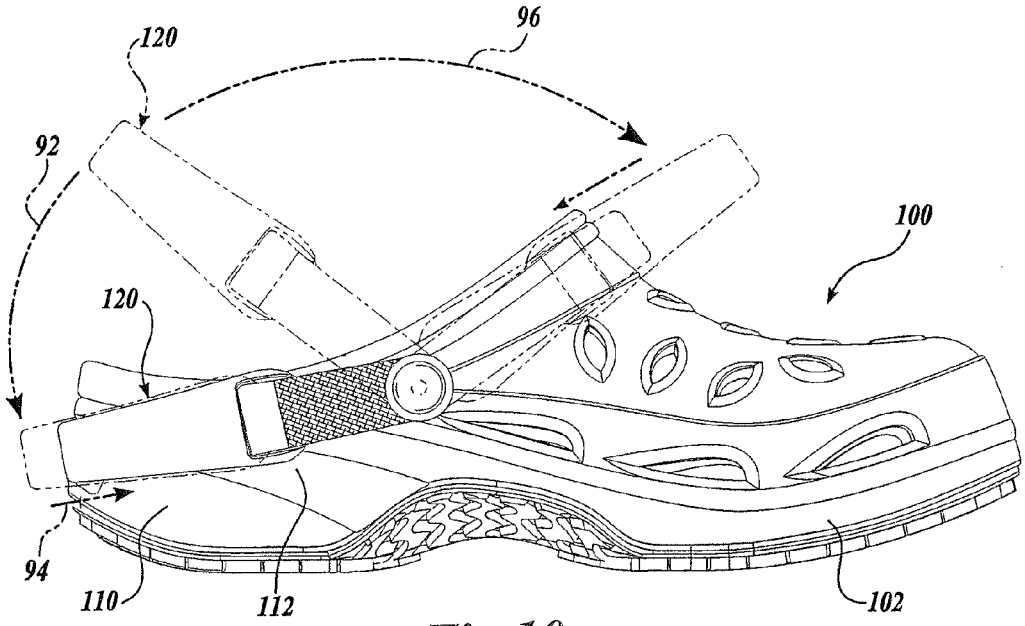
FIG. 10 is a right side view of the clog shown in FIG. 1, wherein the heel strap is retained in the channel in the heel portion of the sole, with other heel strap positions shown in phantom

Refer now to FIGS. 9 and 10, which show a side view of the clog 100. In FIG. 9 the heel strap 120 is shown in an upward position, but is pulled rearwardly, as indicated by arrow 90, such that the end portions 124 are stretched. In this stretched position, the user can rotate the heel strap 120, for example downwardly or counterclockwise as indicated by arrow 92 in FIG. 10, such that the heel strap 120 overlies the channel 112 in the heel portion 110 of the sole 102. The user may then release the heel strap 120, such that the end portions 124 at least partially unstretch or partially relax as indicated by arrow 94, such that the intermediate portion is biased towards the heel portion 110. The end portions 124 are sized such that the intermediate portion 122 of the heel strap 120 is biased toward the heel portion 110 and retained in the channel 112 when the heel strap 120 is rotated behind the heel portion 110.

Alternatively, the heel strap 120 may be rotated forwardly or clockwise in FIG. 10, as indicated by arrow 96, such that the intermediate portion 122 of the heel strap 120 overlies a portion of the instep upper portion 104.

It will now be appreciated that the unique heel strap 120 configuration allows a user to use the clog in a variety of modes. For casual use and for ease of putting on and taking off the clog 100, the user may retain the heel strap 120 in the channel 112 behind the heel portion 110 of the sole 102. Then, if the user decides to undertake more vigorous activities, such as running or playing sports, or activities wherein it is more important to secure the clog 100 such as wading or boating, the user may pull the heel strap 120 up, generally over the user's heel. As a third option, if the user does not want to use the heel strap 120 for a period of time, the heel strap 120 may be removed from the sole 102 by releasing the snaps 126 (or other fasteners).

In a particular embodiment, the clog sole 102 and instep upper portion 104 are molded from a polymeric foam as a single, unitary structure having a particular color. The intermediate portion 122 of the heel strap 120 is molded from the same, or a similar, polymeric foam, and the elastic strap end portions 124 are made of a similar color and affixed to the intermediate portion 122. The snaps 126 are affixed to the sole 102 or instep upper portion 104 and to the end portions 124, such that the heel strap 120 may be removably attached to the sole 102. It will be appreciated that in this embodiment, when the heel strap 120 is in the latched position in the channel 112 behind the heel portion 110, it blends in very closely with the sole 102, and is virtually unnoticeable during use.

While the preferred embodiment of the invention has been illustrated and described, it will be appreciated that various changes can be made therein without departing from the spirit and scope of the invention.

What is claimed as new and desired to be protected by Letters Patent of the United States is:

1. A method of selectively securing footwear to a foot, comprising:

providing a sole, having a channel formed therein;

providing a heel strap that is attachable to the sole such that, when attached to the sole, the heel strap is pivotable to selectively secure the sole to a foot of a user and is pivotable to be selectively retained by the channel formed in the sole, wherein the channel extends around at least a portion of a heel portion of the sole, and wherein the channel is sized and positioned to accommodate and selectively retain the heel strap, wherein the heel strap comprises an elongated intermediate portion with a first end and a second end opposite to the first end;

a first elastic end portion that is attached to the first end of the intermediate portion and that is arranged to be attachable to the sole at a first heel strap attachment point disposed on the sole, and a second elastic end portion that is attached to the second end of the intermediate portion and that is arranged to be attachable to the sole at a second heel strap attachment point disposed on the sole, wherein the first elastic end portion and the second elastic end portion each comprise elastically stretchable material that is significantly more elastic than the intermediate portion;

placing the sole onto the foot; and pivoting the heel strap along the first and second heel strap attachment points from a retained position in the channel onto a heel of the foot to secure the sole to the foot.

2. The method claim 1, further comprising:

pivoting the heel strap to be retained by the channel.

3. The method of claim 1, further comprising:

detaching the heel strap from the sole by unsnapping a first snap of the first heel strap attachment point and unsnapping a second snap of the second heel strap attachment point.

4. The method of claim 1, wherein the heel strap is permanently attached to the sole.

5. The method of claim 1, wherein pivoting the heel strap from the retained position in the channel onto the heel of the foot comprises:

stretching the first elastic end portion and the second elastic end portion such that the intermediate portion is lifted out of the channel; and pivoting the heel strap to a position over the heel; and releasing, in part, the stretching of the first elastic end portion and the second elastic end portion.

6. A method of selectively securing footwear to a foot, comprising:

providing a sole, the sole defining a channel configured and arranged for receiving a portion of a heel strap, the channel extending around at least a portion of a heel portion of the sole;

providing an instep upper portion attached to the sole, the instep upper portion comprising a plurality of heel strap attachment points;

providing a heel strap that is attachable to the instep upper portion such that, when the heel strap is attached to the instep upper portion, the heel strap is pivotable to selectively secure the sole to a foot of a user and is pivotable to be selectively retained on the footwear, wherein providing the heel strap comprises:

providing an elongated intermediate portion with a first end and a second end opposite to the first end;

providing a first elastic end portion that is attached to the first end of the intermediate portion and that is arranged to be attachable to a first heel strap attachment point of the plurality of heel strap attachment points; and providing a second elastic end portion that is attached to the second end of the intermediate portion and that is arranged to be attachable to a second heel strap attachment point of the plurality of heel strap attachment points, wherein the first elastic end portion and the second elastic end portion each comprise elastically stretchable material that is significantly more elastic than the intermediate portion;

placing the sole onto the foot; and pivoting the heel strap along the first and second heel strap attachment points from a retained position in the channel onto a heel of the foot to secure the sole to the foot.

7. The method of claim 6, further comprising:

detaching the heel strap from the instep upper portion by uncoupling the first heel strap from the first heel strap attachment point and uncoupling the second heel strap from the second heel strap attachment point.

8. The method claim 1, wherein the intermediate portion of the heel strap comprises a foam polymer.

9. The method of claim 1, further comprising providing an instep upper portion attached to the sole.

10. The method of claim 1, wherein the footwear is a clog.

* * * * *